United States Patent [19]

Bolten et al.

[11] 4,350,174

[45] Sep. 21, 1982

[54] PLANT FOR CLEANING CASTINGS AND THE LIKE

[75] Inventors: Michael Bolten, Mulhheim an der Ruhr, Fed. Rep. of Germany; Henry L. Carpenter, Edison, N.J.

[73] Assignee: Woma Corporation, South Plainfield, N.J.

[21] Appl. No.: 238,129

[22] Filed: Feb. 25, 1981

[51] Int. Cl.[3] ..... B08B 3/02

[52] U.S. Cl. ..... 134/104; 134/140; 134/153; 134/161; 134/200

[58] Field of Search ..... 134/104, 109, 111, 140, 134/149, 153, 161, 200

[56] References Cited

U.S. PATENT DOCUMENTS

| | | | |
|---|---|---|---|
| 2,797,530 | 7/1957 | Garver | 134/200 X |
| 2,903,002 | 9/1959 | Adkins | 134/161 |
| 3,076,468 | 2/1963 | Belt | 134/153 X |
| 3,227,166 | 1/1966 | Martz | 134/161 X |
| 3,439,689 | 4/1969 | Zadron et al. | 134/111 X |
| 3,802,916 | 4/1974 | Jackson | 134/104 X |

FOREIGN PATENT DOCUMENTS

| | | | |
|---|---|---|---|
| 2098749 | 3/1972 | France | 134/111 |

*Primary Examiner*—Robert L. Bleutge
*Attorney, Agent, or Firm*—Karl F. Ross

[57] ABSTRACT

A plant for cleaning intricate workpieces such as investment castings comprises a blast cabinet in which a workpiece to be cleaned is supported on a tiltable turntable with a fully enclosed drive mechanism. A cabinet wall provided with a viewing window has a gimbal through which a high-pressure water gun projects toward the turntable. The position of the turntable can be adjusted with the aid of a control panel outside the cabinet within reach of an operator handling the water gun. Solids dislodged by the water blast are collected in a settling cart underneath the cabinet which has an overflow trough for water to be recirculated to a supply tank by way of a system of pumps and filtering devices. A safety switch responsive to unlatching of the cabinet door cuts off the water supply to the gun as long as that door is not properly closed.

10 Claims, 8 Drawing Figures

PLANT FOR CLEANING CASTINGS AND THE LIKE

FIELD OF THE INVENTION

Our present invention relates to a plant for the cleaning of intricate metallic workpieces, such as investment castings.

BACKGROUND OF THE INVENTION

It has already been proposed to use a water gun for directing a high-pressure spray onto a workpiece to be cleaned and to hold that workpiece during the cleaning operation on a temporary support, leaving it accessible from all sides except at its base. Attempts to design the support as a tiltable turntable, in order to avoid the need for lugging the water gun around, have run into problems of protecting the drive mechanism of that turntable from the detritus swept off the workpiece and entrained by the runoff. A similar problem arises when a recirculation system is used for the sake of water conservation as the entrained solids tend to interfere with the operation of the pumps.

OBJECTS OF THE INVENTION

The general object of our present invention, therefore, is to provide an improved plant for the purpose set forth in which these drawbacks are avoided.

Another object is to provide means for effectively protecting an operator as well as sensitive equipment from the high-pressure spray trained upon a workpiece to be cleaned.

SUMMARY OF THE INVENTION

In accordance with our present invention, a turntable adapted to hold a workpiece to be cleaned is provided with a central shaft coupled with first drive means for rotating that turntable which is mounted on a nonrotatable platform coupled with second drive means for swinging same together with the turntable about a horizontal tilt axis intersecting the axis of rotation. The platform and the turntable are surrounded by an enclosure which is at least partly transparent to enable the workpiece to be viewed by an outside operator manipulating a water gun which is universally jointed in a wall of that enclosure; the two drive means can be selectively actuated by control means disposed outside the enclosure within reach of the operator. The water gun is connected to an outlet of a high-pressure pump having an inlet connected to a water supply while a collector underneath the turntable catches spent water and accompanying detritus.

Advantageously, pursuant to a more particular feature of our invention, the collector is connected to the water supply via a recirculation system including filtration means for receiving entrained solids, the filtration means preferably including one or more cyclone separators in series with a microfilter.

According to another advantageous feature of our invention, the turntable-supporting platform is hollow and accommodates in its interior an output shaft of a first drive motor connected by a gear train inside the platform with the central shaft of the turntable; this output shaft is coaxially surrounded by a tubular output shaft of a second drive motor fixed to the hollow platform. Thus, the rotary drive for the turntable is completely shielded by the supporting platform and by the tubular shaft of its tilt drive, this latter shaft and a possible extension thereof on the other side of the platform being the only exposed parts of the mechanism.

BRIEF DESCRIPTION OF THE DRAWING

The above and other features of our invention will now be described in detail with reference to the accompanying drawing in which.

SPECIFIC DESCRIPTION

Figure 1:
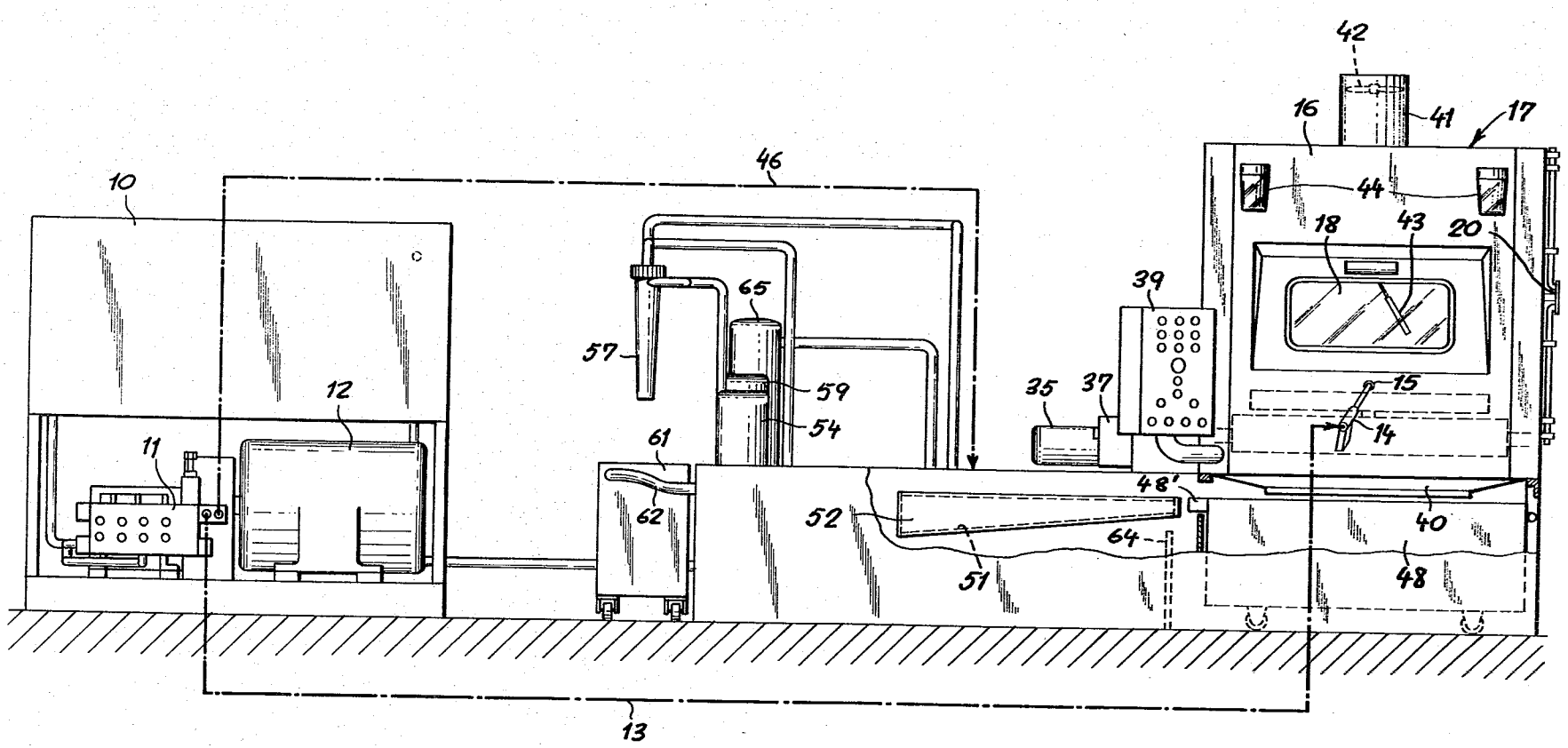
FIG. 1 is a partly diagrammatic elevational view of a plant embodying our invention.
Figure 2:
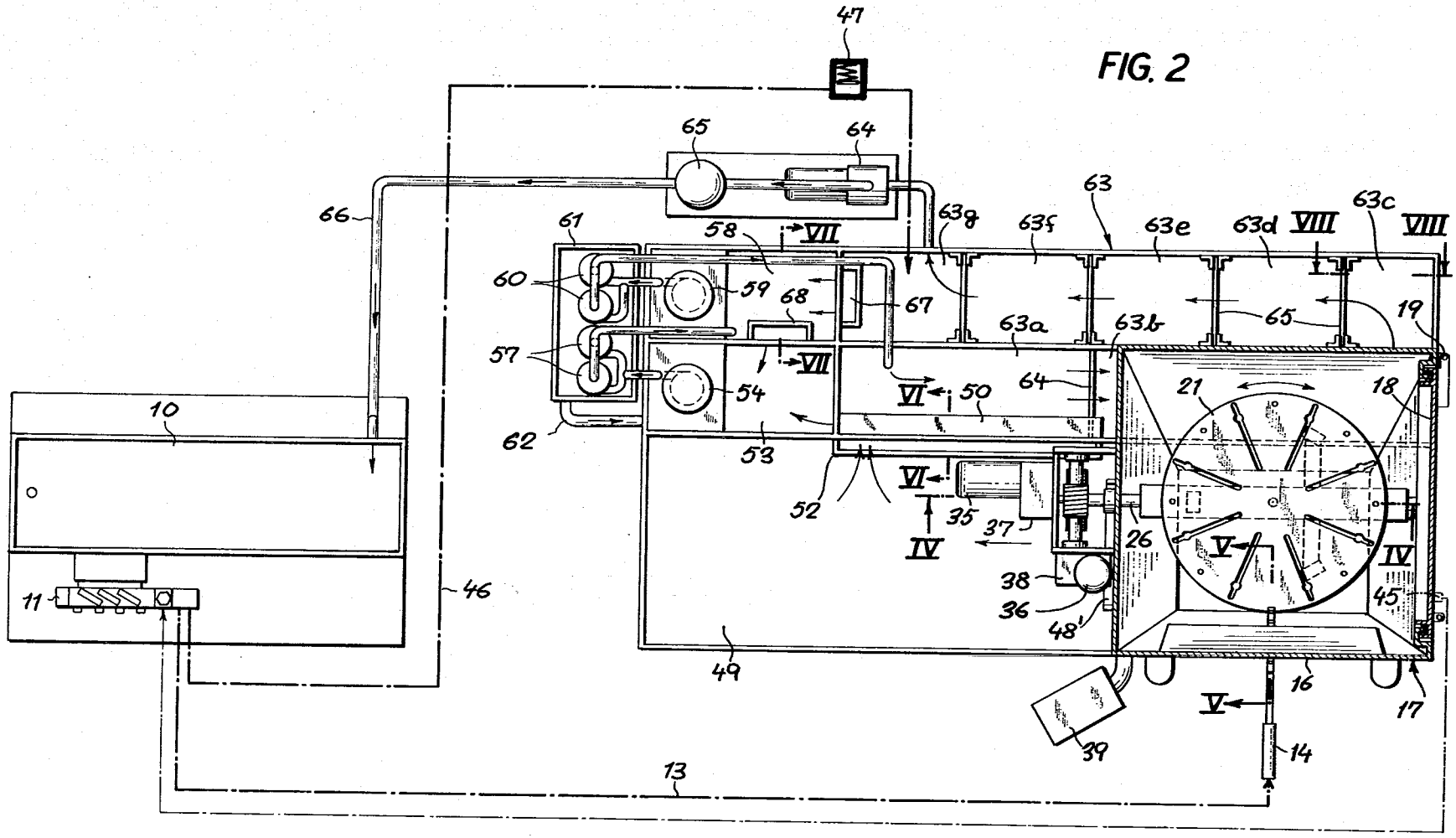
FIG. 2 is a top view of the plant shown in FIG. 1.

In FIGS. 1 and 2 we have shown a plant for cleaning investment castings in accordance with our invention, comprising a supply tank 10 for water drawn by a high-pressure pump 11 which is driven by a motor 12 and is connected via a conduit 13 to the intake end of a water gun 14. The latter is universally jointed by a gimbal mounting 15, described hereinafter with reference to FIG. 5, in a wall 16 of a blast cabiner 17 which has a viewing window 18 above that gun. Cabinet 17 further has a door 18 secured thereto by hinges 19 and provided with a safety latch 20.

Figure 3:
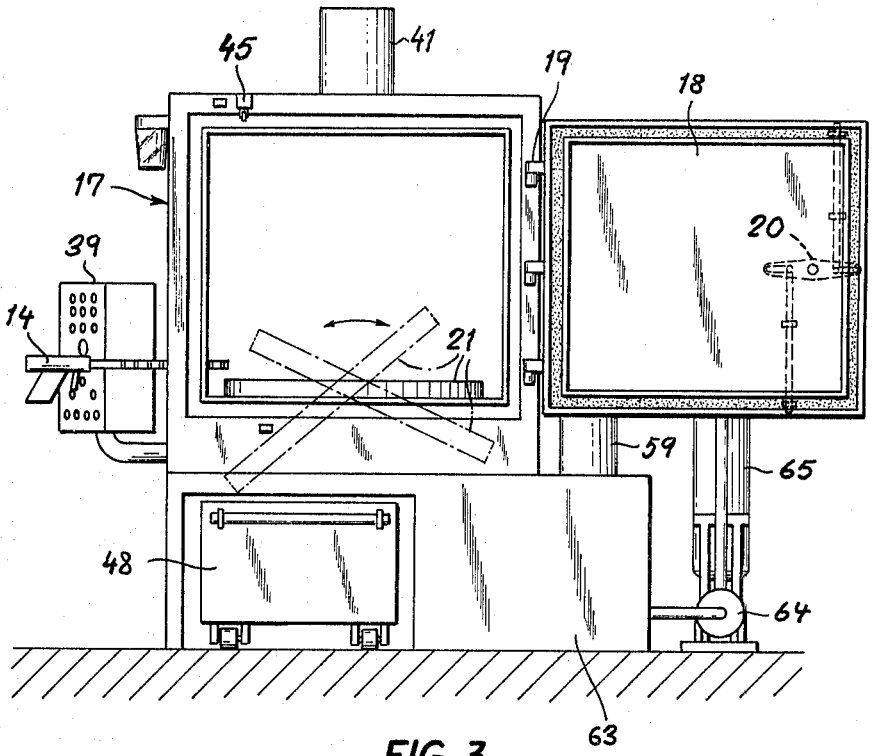
FIG. 3 is an elevational view of a blast cabinet forming part of the plant.
Figure 4:
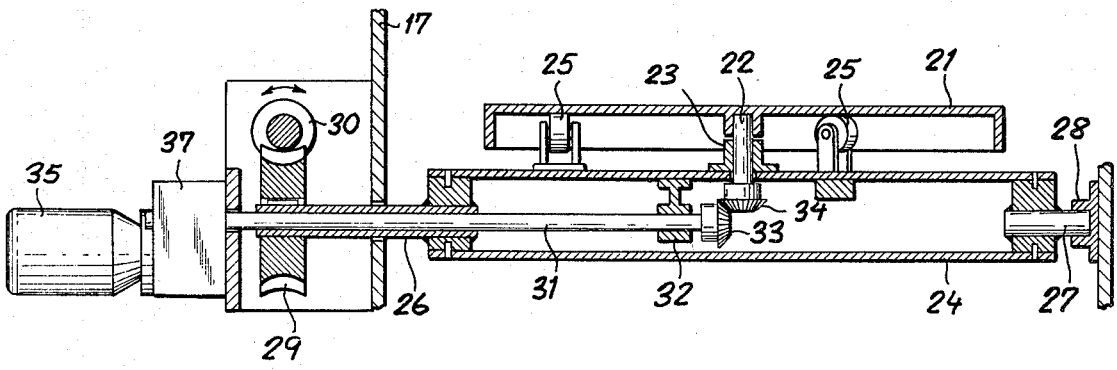
FIG. 4 shows, in axial section, a turntable and parts of an associated drive mechanism located in the blast cabinet of FIG. 3.

Cabinet 17 encloses a workpiece support comprising, as shown in FIGS. 3 and 4, a radially slotted turntable 21 to which a nonillustrated workpiece can be temporarily fastened for spraying with a high-pressure jet from gun 14. Turntable 21 has a stub shaft 22 defining a central axis of rotation therefor, this shaft being journaled in a bearing 23 on a hollow platform 24 whose upper surface carries rollers 25 engaging the turntable 21 near its periphery. The central axis of turntable 21 intersects a horizontal tilt axis defined by a tubular shaft 26 rigid with platform 24 and an extension 27 thereof journaled in a bearing 28 on an inner wall surface of cabinet 17. Shaft 26 traverses an opposite cabinet wall and carries a worm gear 29 meshing with a worm 30. Another shaft 31 coaxially extends inside tubular shaft 26 and is supported inside platform 24 by a bearing 32; a bevel gear 33 on shaft 31 meshes with another bevel gear 34 on shaft 22.

Two reversible motors 35 and 36 (see also FIG. 2) drive the shaft 31 and the worm 30 by way of respective speed reducers 37 and 38; the motors and speed reducers are located outside the blast cabiner 17 and can be selectively operated by a control panel 39. This panel has a number of knobs or pushbuttons, easily reached by an operator handling the water gun 14, for actuating either motor in one or the other direction as well as for controlling the pump 11 and other equipment of the plant. Platform 24 may have a tilt angle close to $\pm 45°$ as indicated by the turntable positions shown in plantom lines in FIG. 3.

Cabinet 17 has a drain 40 at its bottom and a flue 41 with a damper 42 at its top. Window 18 is provided with a wiper 43. Warning lights 44 on cabinet wall 16 are energizable by a door-actuated switch to indicate that the cabinet is open. A safety switch 45 is tripped upon an accidental release of latch 20, during operation of pump 11, to shift its high-pressure outlet from conduit 13 to a bypass 46 including a relief valve 47.

Figure 6:
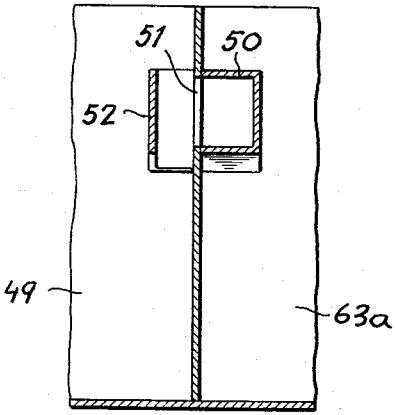

The drain 40 opens into a settling cart serving as a movable receptacle for the detritus flushed off the workpiece on turntable 21. The cart 48 has an overflow through 48 from which water accompanying the solids spills into a first settling tank 49. The latter communicates via a sloping trough 50 (see also FIG. 6), whose entrance 51 is guarded by a splash shield 52, into a pump chamber 53 from which a pump 54 delivers the water to a first pair of hydrocyclones 57 discharging into a second pump chamber 58 connected by a pump 59 to a second pair of hydrocyclones 60. The four hydrocyclones overhang another settling cart 61 from which an overflow connection 62 extends back to tank 49.

Figure 8:
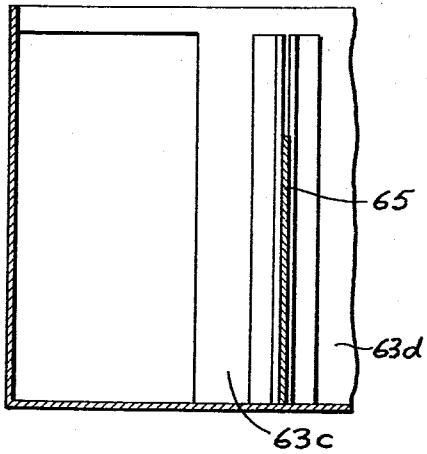
FIGS. 6, 7 and 8 are enlarged sectional detail views respectively taken on lines VI—VI, VII—VII and VIII—VIII of FIG. 2.

The water, having undergone partial purification in these hydrocyclones, is discharged into a second settling tank which is divided by a weir 64 and several movable barriers 65 into a number of compartments 63*a*, 63*b*, 63*c*, 63*d*, 63*e*, 63*f*, 63*g*; see also FIG. 8. The bypass 46 opens, downstream of valve 47, into compartment 63*g* from which the water is drawn by a pump 64 for final purification into a microfilter 65 before being returned via a line 66 to the supply tank 10.

The compartmentation of tank 63 is designed to stabilize the flow exiting from hydrocyclones 60.

Figure 7:
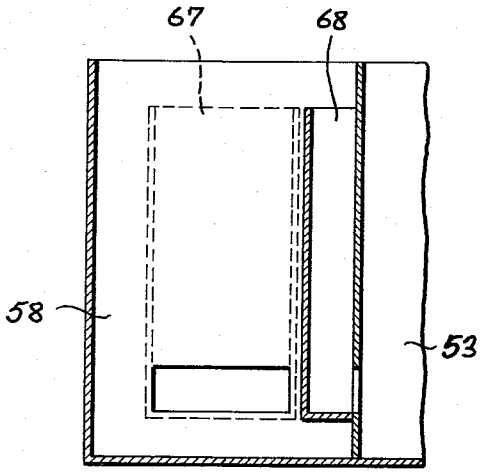

Compartment 63*g* is further provided (see also FIG. 7) with an overflow 67 for returning excess water to pump chamber 58 which in turn communicates via another overflow 68 with pump chamber 53.

Figure 5:
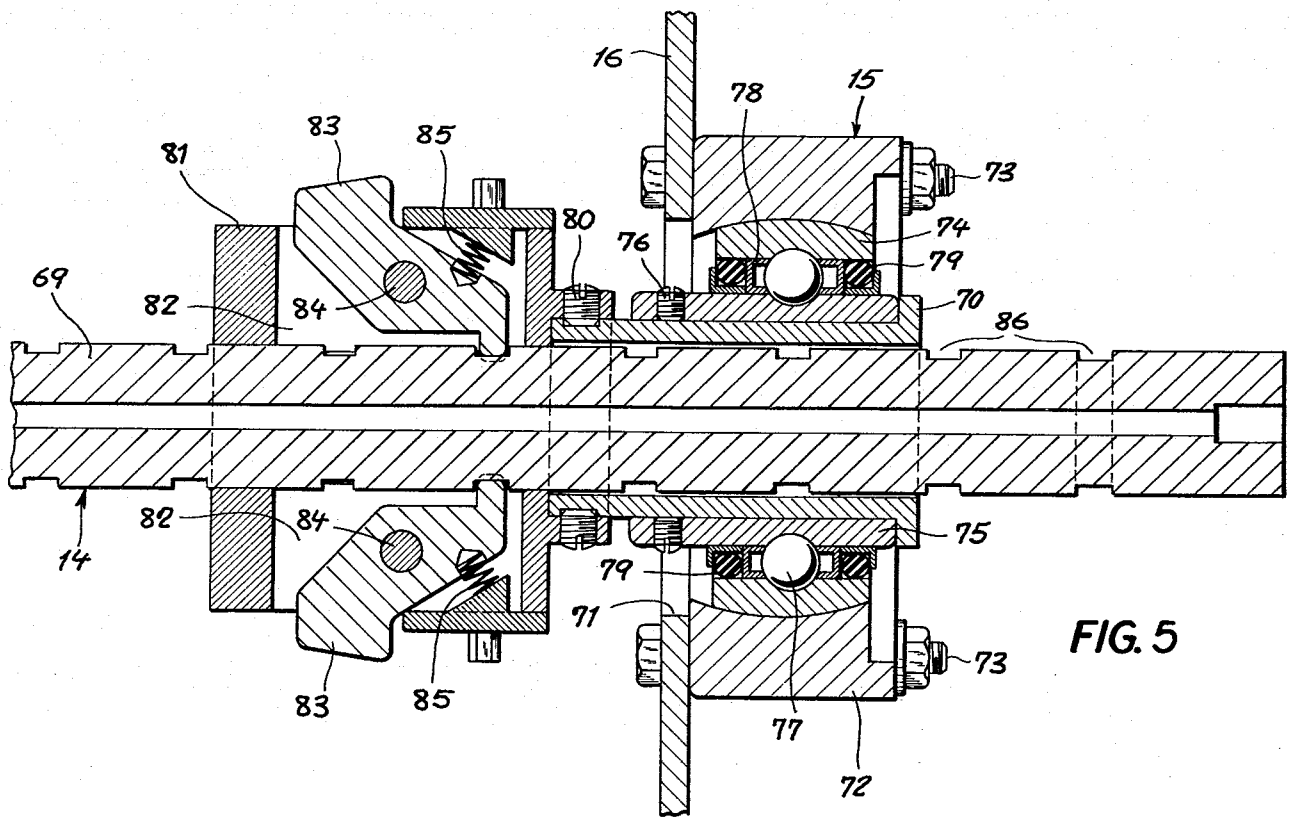
FIG. 5 is an enlarged sectional view, taken on the line V—V of FIG. 2, of a gimbal mounting for a water gun extending into the blast cabinet.

As illustrated in FIG. 5, water gun 14 has a barrel 69 axially slidable in a sleeve 70 that traverses an aperture 71 in cabinet wall 16 to which a housing 72 of gimbal mounting 15 is secured by screws 73. Housing 72 has a spherically concave inner wall surface along which a complementarily shaped outer space 74 of a ball bearing is swivelable. An associated inner bearing race 75 is fastened by grub screws 76 to the sleeve 70, the balls 77 of the bearing being held in a cage 78 flanked by annular gaskets 79. Sleeve 70 is attached by grub screws 80 to a cylinder 81 with diametrically opposite recesses 82 accommodating respective lugs 83 which are pivotable about pins 84 and urged by springs 85 into indexing engagement with notches 86 on gun barrel 69. By retracting the lugs 83, the operator may release the barrel 69 for axial displacement relative to the assembly 70, 81 which in turn is rotatable as well as swivelable in gimbal mounting 15.

The several pumps of the water-circulating system are, of course, turned on only when a workpiece is being cleaned, with the cabinet door 18 closed and with the settling carts 47 and 61 in place. The aforementioned safety switch 45 protects the operator and others in the event that someone else, through inadvertence, opens the door while the water gun 14 is in use.

We claim:

1. A plant for cleaning intricate metallic workpieces, comprising:

a turntable adapted to hold a workpiece to be cleaned in a fixed position thereon, said turntable being provided with a central shaft;

first drive means coupled with said shaft for rotating said turntable about a central axis;

a nonrotatable platform supporting said turntable;

second drive means coupled with said platform for swinging same together with said turntable about a horizontal tilt axis intersecting said central axis;

an enclosure surrounding said platform and said turntable, said enclosure being at least partly transparent to enable viewing of said turntable and said workpiece by an outside operator;

a water gun universally jointed in a wall of said enclosure for manipulation by the operator to train a high-pressure jet upon said workpiece;

control means within reach of the operator outside said enclosure for selectively actuating said first and second drive means;

a high-pressure pump with an inlet connected to a water supply and with an outlet connected to said water gun; and a collector underneath said turntable for catching spent water and accompanying detritus.

2. A plant as defined in claim 1, further comprising a recirculation system for returning spent water from said collector to said supply, said recirculation system including filtration means for removing entrained solids.

3. A plant as defined in claim 2 wherein said filtration means includes at least one cyclone separator in series with a microfilter.

4. A plant as defined in claim 3 wherein said recirculation system further includes a first settling tank between said collector and said cyclone separator, a second settling tank between said cyclone separator and said microfilter, first ancillary pump means for driving recirculated water from said first settling tank to said cyclone separator, and second ancillary pump means for driving recirculated water from said second settling tank into said microfilter.

5. A plant as defined in claim 4 wherein said second settling tank is divided into a series of compartments separated by weirs.

6. A plant as defined in claim 4 or 5 wherein said collector is a first settling cart with an overflow connection to said first settling tank, further comprising a second settling cart underneath said cyclone separator with an overflow connection to an intake of said first ancillary pump means.

7. A plant as defined in claim 2, 3, 4 or 5 wherein said enclosure is provided with a door giving access to said turntable, further comprising a bypass extending from said high-pressure pump to said recirculation system and a safety switch responsive to an unlatching of said door for diverting water delivered by said high-pressure pump from said water gun to said bypass.

8. A plant as defined in claim 1, 2, 3, 4 or 5 wherein said platform is hollow, said first drive means including a first motor with a first output shaft extending along said tilt axis into said platform and gear means inside said platform coupling said first output shaft with said central shaft, said second drive means including a second motor with a tubular second output shaft coaxially surrounding said first output shaft and terminating at said platform.

9. A plant as defined in claim 8 wherein said motors are disposed outside said enclosure.

10. A plant as defined in claim 1, 2, 3, 4 or 5 wherein said water gun is universally jointed in said wall by a gimbal comprising a mounting ring with a spherically concave inner peripheral surface secured to a surface of said wall, an antifriction bearing with an outer race having a spherically convex surface in contact with said concave peripheral surface and having an inner race in the shape of a cylindrical sleeve, said water gun having a barrel slidably received in said sleeve, and indexing means on said sleeve for releasably holding said barrel in different axial positions relative thereto.

* * * * *